US006559370B1

(12) United States Patent
Barker

(10) Patent No.: US 6,559,370 B1
(45) Date of Patent: May 6, 2003

(54) SUBMARINE COUNTERMEASURE VEHICLE WITH FOLDING PROPELLER

(75) Inventor: William P. Barker, Bristol, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/214,527

(22) Filed: Aug. 6, 2002

(51) Int. Cl.[7] ..... F42B 17/00

(52) U.S. Cl. ..... 114/20.2; 114/20.1; 114/236; 114/238; 244/3.24; 244/3.27; 244/3.28; 244/3.29; 244/63; 416/138; 416/142

(58) Field of Search ..... 244/3.24, 3.27, 244/3.28, 3.29, 63; 114/20.1, 20.2, 236, 238; 416/138, 142

(56) References Cited

U.S. PATENT DOCUMENTS

| | | | | | |
|---|---|---|---|---|---|
| 938,290 | A | * | 10/1909 | Thompson | 416/138 |
| 2,481,751 | A | * | 9/1949 | Godfrey | 416/142 |
| 2,608,257 | A | * | 8/1952 | James | 416/142 |
| 2,847,960 | A | * | 8/1958 | Endrezze | 114/20.1 |
| 3,690,595 | A | * | 9/1972 | Rusbach | 244/3.27 |
| 3,790,104 | A | * | 2/1974 | Jones | 244/3.27 |
| 3,918,664 | A | * | 11/1975 | Grosswendt | 244/3.28 |
| 4,440,360 | A | * | 4/1984 | Hallstrom | 244/3.28 |
| 5,082,203 | A | * | 1/1992 | Baubry | 244/3.28 |
| 5,343,823 | A | * | 9/1994 | Blaha | 114/338 |
| 5,452,864 | A | * | 9/1995 | Alford et al. | 244/3.23 |
| 6,314,886 | B1 | * | 11/2001 | Kuhnle et al. | 244/3.2 |
| 6,367,401 | B1 | * | 4/2002 | Correia et al. | 114/238 |

FOREIGN PATENT DOCUMENTS

| | | |
|---|---|---|
| CH | 3320850 | * 11/1958 |
| CH | 375628 | * 11/1961 |
| DE | 1195204 | * 6/1965 |
| GB | 1188651 | * 4/1970 |

* cited by examiner

*Primary Examiner*—Michael J. Carone
*Assistant Examiner*—John Richardson
(74) *Attorney, Agent, or Firm*—James M. Kasischke; Michael J. McGowan; Michael F. Oglo

(57) ABSTRACT

A submarine countermeasure vehicle includes an elongated body for supporting a countermeasure device, and a propulsion assembly mounted on an after end of the body. The propulsion assembly includes a rotatable propeller hub, propeller blades mounted on the hub and moveable between a first position wherein the blades extend substantially radially outwardly from the hub, and a second position wherein the blades extend generally axially of the hub. A spring is mounted on each of the blades and in the hub, the spring biasing the blades toward the first position, but of sufficient flexibility to permit the blades to move to the second position upon launch of the vehicle from an underwater launch tube.

5 Claims, 5 Drawing Sheets

SUBMARINE COUNTERMEASURE VEHICLE WITH FOLDING PROPELLER

CROSS REFERENCE TO OTHER PATENT APPLICATION

This patent application is co-pending with one related patent application Ser. No. 10/214,544 entitled SUBMARINE COUNTERMEASURE PROPELLER PROTECTOR, by the same inventor as this application.

STATEMENT OF GOVERNMENT INTEREST

The invention described herein may be manufactured and used by and for the Government of the United States of America for Governmental purposes without the payment of any royalties thereon or therefor.

BACKGROUND OF THE INVENTION (1) Field of the Invention

The invention relates to submarine underwater countermeasures assemblies and is directed more particularly to an improved countermeasure vehicle.

(2) Description of the Prior Art

In FIG. 1, there is shown a typical submarine countermeasure apparatus 20. The apparatus 20 includes a launch tube 22 which, in operation, is disposed outboard of the submarine pressure hull (not shown). A countermeasure vehicle 24 is housed in the launch tube 22 and includes an array assembly 26 and a tailcone assembly 28. The array assembly 26 is protected by a surrounding sabot 30. Disposed in the launch tube 22 is a ram plate 32 and a gas generator 34. The launch tube 22 is closed by a forward tube cover 36 and an after tube cover 38.

In operation, the gas generator 34 is activated by an electrical pulse from the submarine fire control system and generates sufficient gas pressure to move the ram plate 32 forward. The ram plate 32 in turn pushes the countermeasure vehicle 24 forward, breaking away the forward tube cover 36 and launching the countermeasure vehicle 24 from the launch tube 22. In short order, the sabot 30 disengages from around the array assembly 26 and the array assembly is deployed.

The tail cone assembly 28 includes a propulsion propeller assembly (not shown in FIG. 1), and the countermeasure vehicle 24 houses a motor (not shown in FIG. 1) which drives the propeller to position the countermeasure in a column of water.

It has been found that upon launch of the vehicle 24, a combination of a high velocity launch, high forward speed of the submarine, and strong underwater currents, can subject the propeller blades to pressures and bending moments sufficient to damage the blades. Damaged propeller blades can adversely affect the ability of the countermeasure to hover at a selected depth in the water column, and thereby cause mission failure which places the submarine in a state of increased danger.

Accordingly, there is a need for an improved propeller assembly which can withstand and survive the aforesaid launch conditions and assume operations leading to a successful mission.

SUMMARY OF THE INVENTION

An object of the invention is, therefore, to provide an improved submarine countermeasure vehicle, featuring a propulsion assembly having facility to withstand the rigors of a launch and provide the propulsion needed to successfully complete a mission.

With the above and other objects in view, as will hereinafter appear, a feature of the present invention is the provision of a submarine countermeasure vehicle comprising an elongated body for supporting a countermeasure device, and a propulsion-assembly mounted on an after end of the body. The propulsion assembly comprises a rotatable propeller hub, propeller blades mounted on the hub and moveable between a first position wherein the blades extend substantially radially outwardly from the hub, and a second position wherein the blades extend generally axially of the hub. A spring is mounted on each of the blades and in the hub, the spring biasing the blades toward the first position, but of sufficient flexibility to permit the blades to move to the second position upon launch of the vehicle from an underwater launch tube.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENT

Figure 1:
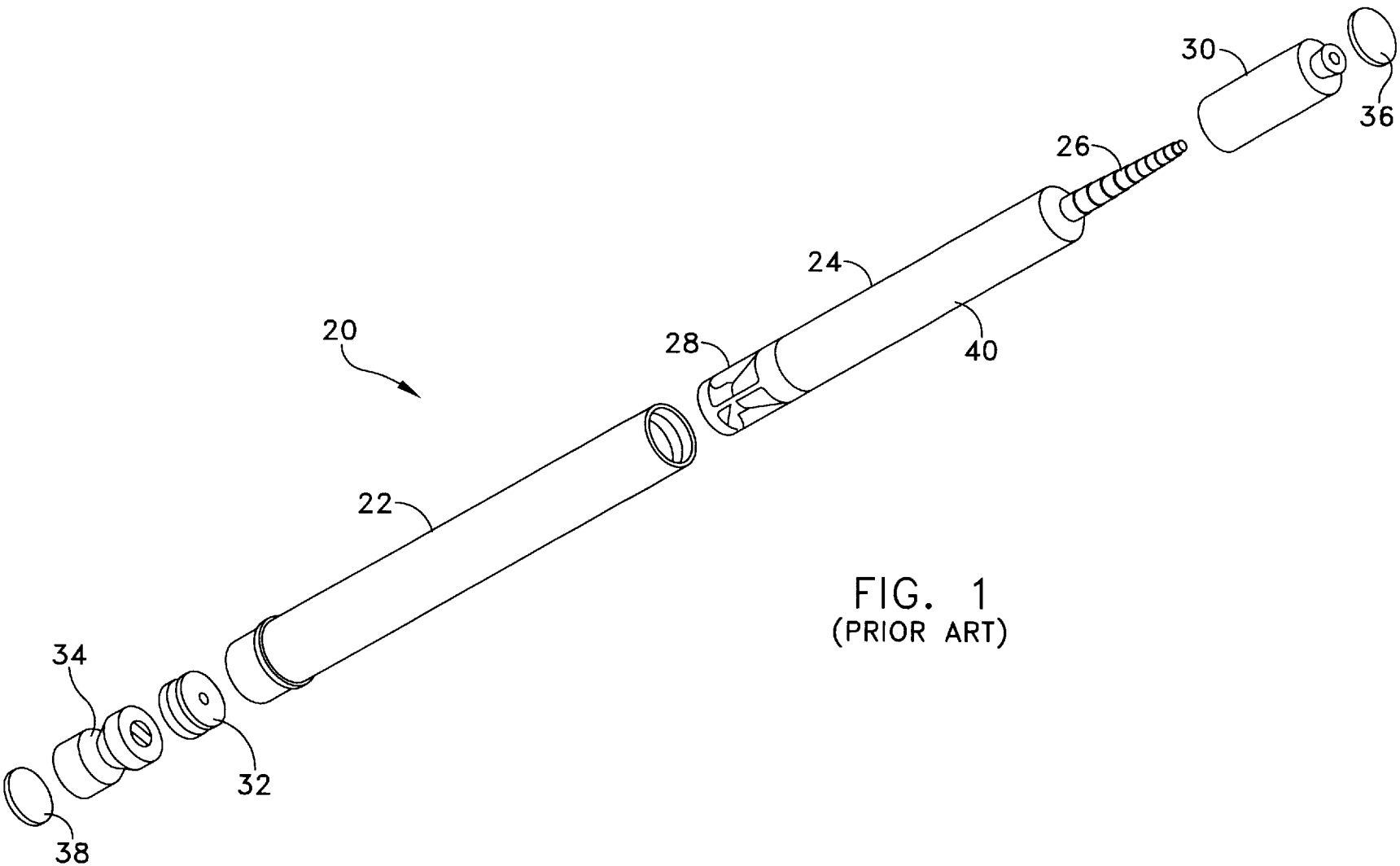
FIG. 1 (PRIOR ART)
FIG. 1 is an exploded perspective view of a submarine countermeasure assembly, including a countermeasure vehicle, known in the art.

Referring again to FIG. 1, it will be seen that the countermeasure vehicle 24 includes an elongated body portion 40 which houses a propulsion motor, not shown but known in the art.

Figure 2:
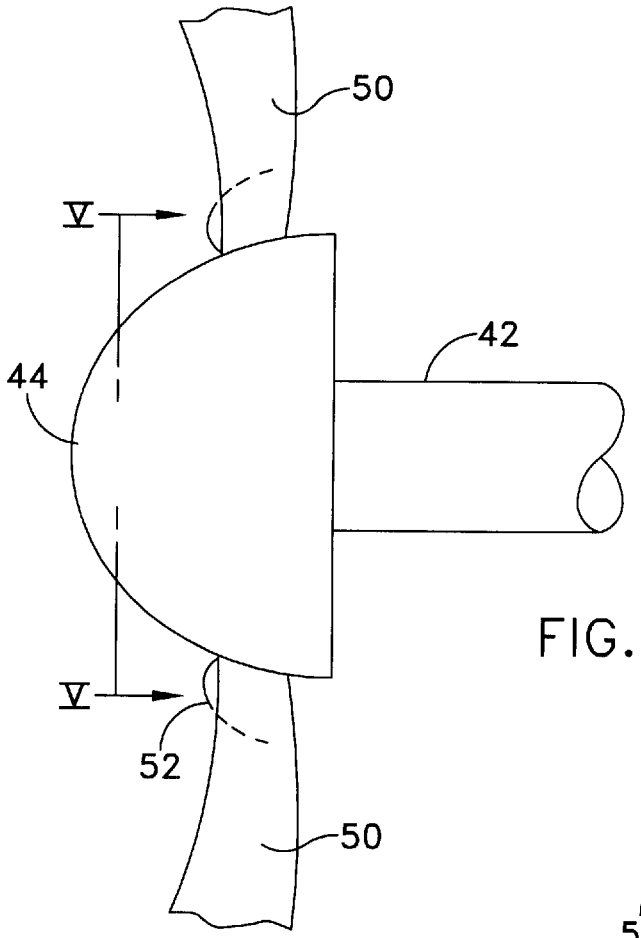
FIG. 2 is a side elevational view of one form of vehicle propulsion propeller assembly illustrative of an embodiment of the invention.
Figure 3:
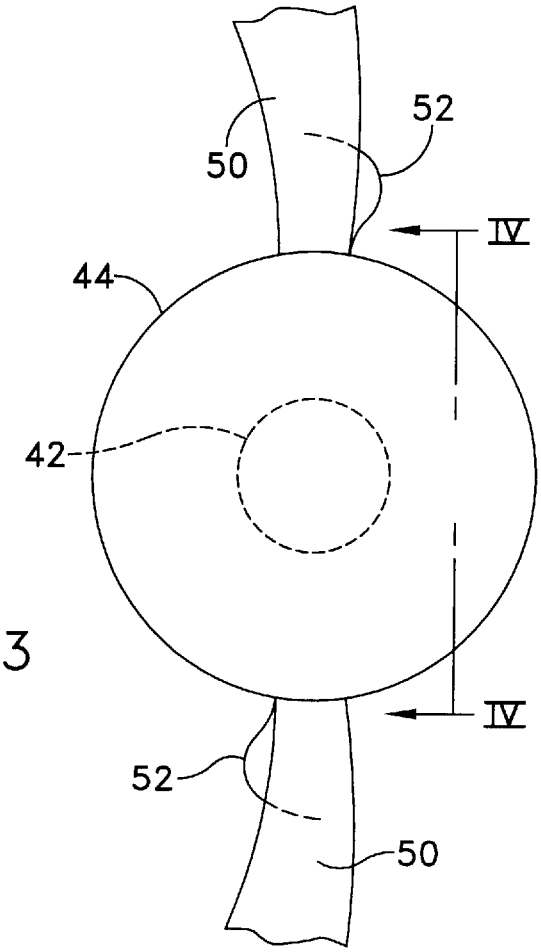
FIG. 3 is a rear elevational view of the propeller assembly of FIG. 2.

Extending from the motor-and from the after end of the body portion 40 and into the tailcone assembly 28 is a propeller shaft 42 (FIGS. 2 and 3). Fixed on an after end of the shaft 42 is a propeller hub 44 which is rotatable with the shaft 42.

Figure 4:
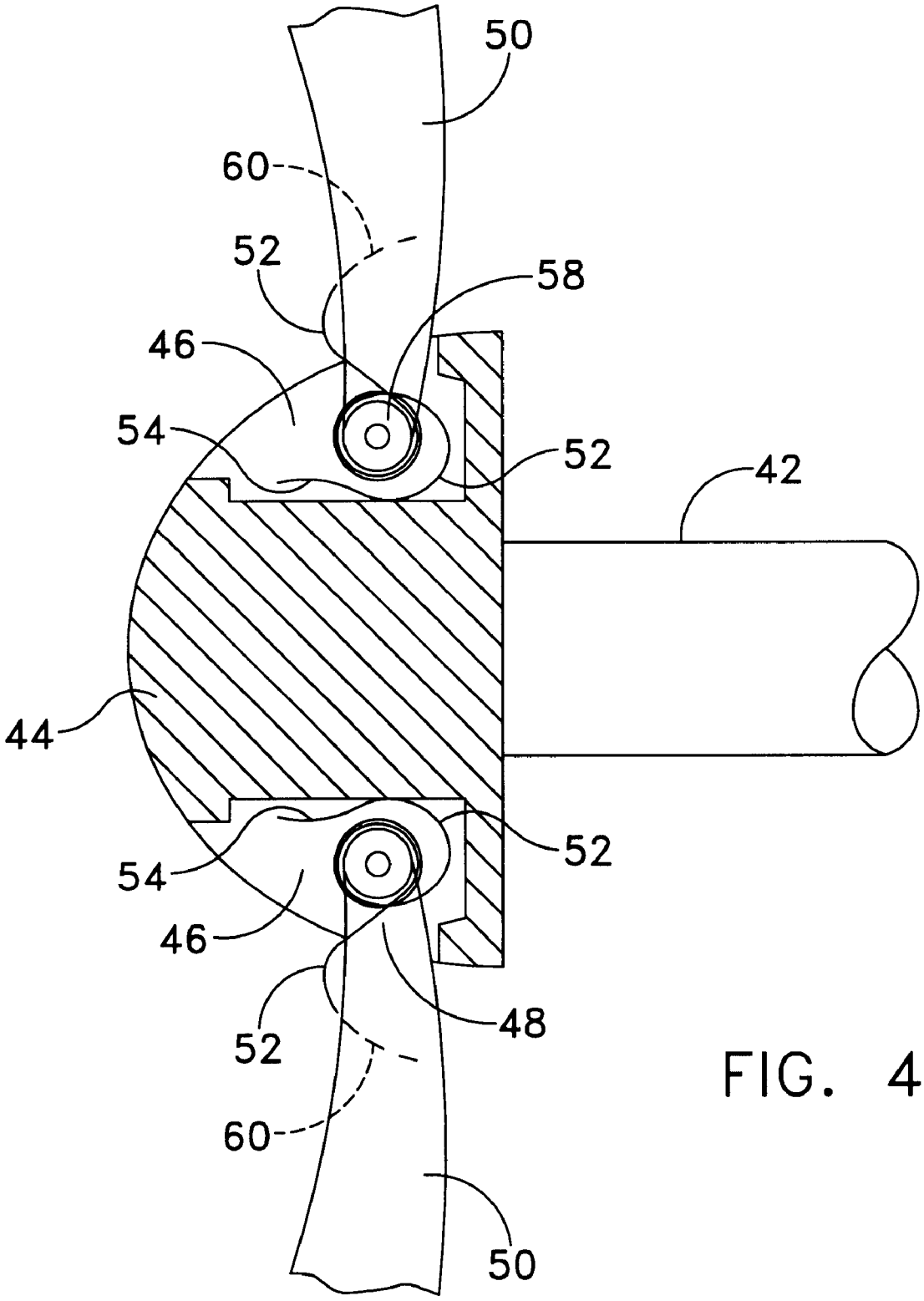
FIG. 4 is a sectional view taken along line IV—IV of FIG. 3.
Figure 5:
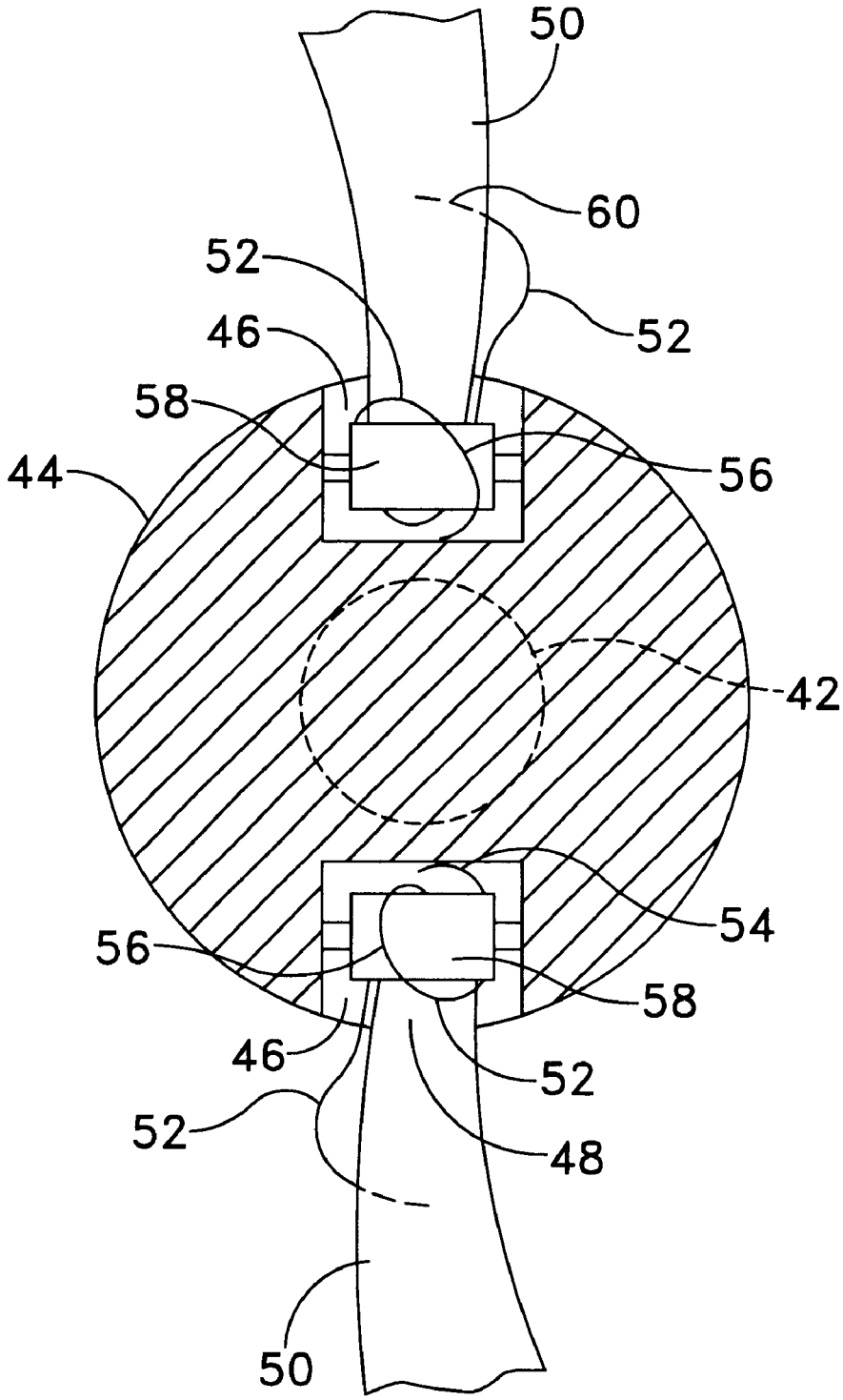
FIG. 5 is a sectional view taken along line V—V of FIG. 2.
Figure 6:
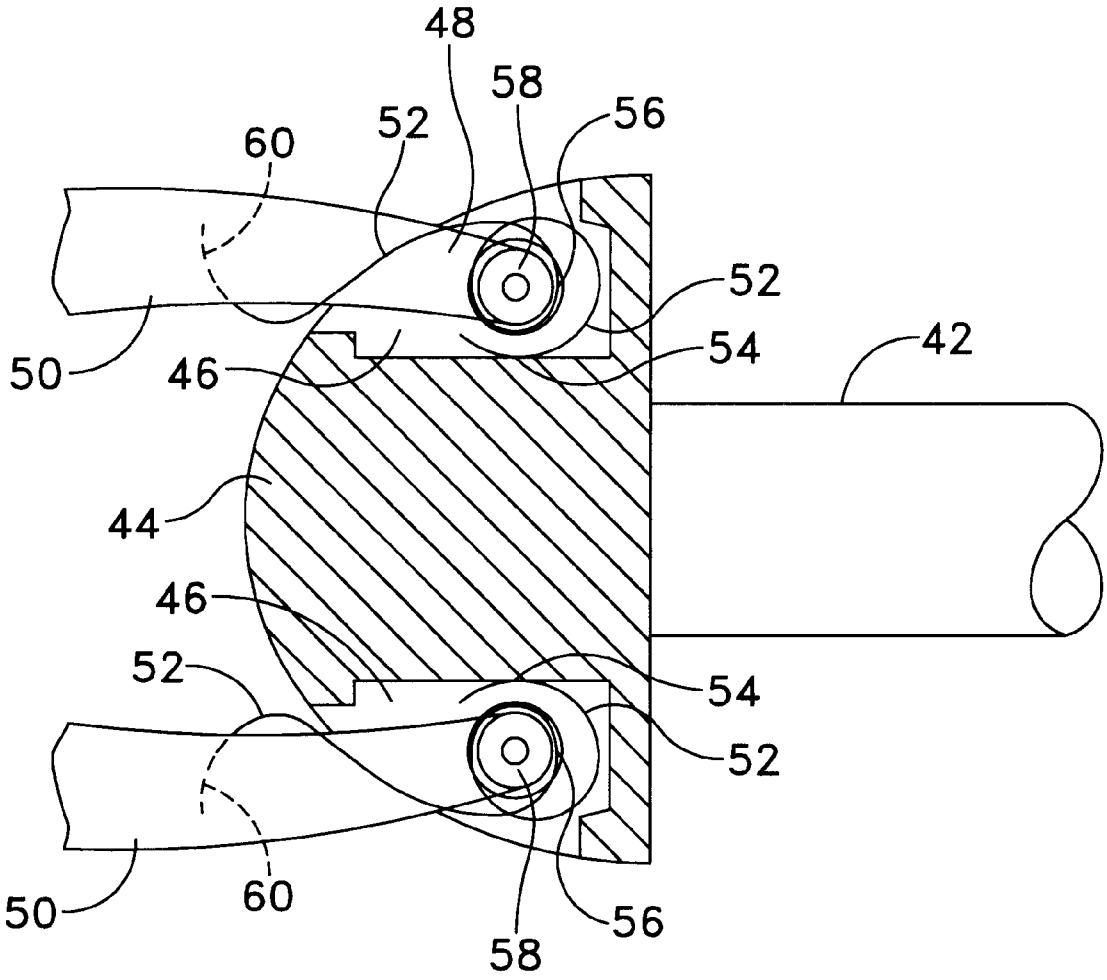
FIG. 6 is similar to FIG. 4, but shows propellers in a different position.

The propeller hub 44 is provided with a plurality of concavities 46 (FIGS. 4–6). A base end portion 48 of each of a plurality of propeller blades 50 is pivotally mounted in one of the concavities 46. The propeller blades 50 are pivotally moveable between a first position wherein the blades 50 extend substantially radially outwardly from the hub 44 (FIGS. 2–5), and a second position wherein the blades 50 extend generally axially of the hub 44 (FIG. 6).

A spring 52 is disposed in each of the concavities 46 and is mounted on each of the blade base ends 48 and in the hub 44. The springs 52 preferably are coiled wire springs each having a first end 54 disposed in a concavity 46, a mid-portion 56 coiled around a spool 58 fixed to each of the propeller blade base end portions 48, and a second end 60 hooked around a propeller blade 50. It will be apparent that other spring arrangements, including leaf springs, and the like, may be used.

The springs 52 bias the blades 50 toward the first position (FIGS. 2–5), but are sufficiently flexible to permit the blades to move to the second position (FIG. 6) under extreme launch conditions.

In a static condition, the countermeasure vehicle 24 rests in the launch tube 22. Upon initiation of a launch, the ram plate 32 forces the vehicle 24 to push away the forward tube cover 36 and eject from the launch tube. As water moves into the tailcone assembly 28, a combination of forces, as described above, exercise undue pressure on the relatively fragile blades. In accordance with the present invention, such forces overcome the force of the springs 52 and cause the blades 50 to pivot rearwardly to assume the position shown in FIG. 6. As soon as the pressure on the blades is relieved, a matter of a few seconds, the springs 52 snap the blades back into their operative positions, the propulsion motor starts, and the propellers rotate to provide the required thrust.

There is thus provided an improved submarine countermeasure vehicle featuring a propeller assembly which survives an unusually harsh launch and assumes normal operation.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A submarine countermeasure vehicle comprising:

an elongated body for supporting a countermeasure device; and a propulsion assembly mounted on an after end of said body, the propulsion assembly comprising:

a rotatable propeller hub;

propeller blades mounted on said hub and moveable between a first position wherein-said blades extend substantially radially outwardly from said hub, and a second position wherein said blades extend generally axially of said hub; and a spring mounted on a spool fixed to and extending from a base portion of each of said blades, the spools each being pivotally mounted in said hub, said springs biasing said blades toward the first position, but of sufficient flexibility to permit said blades to move go the second position upon launch of the vehicle from an underwater launch tube.

2. The vehicle in accordance with claim 1 wherein said hub is provided with a plurality of concavities, the base portion of each of said propeller blades is pivotally disposed in one of the concavities, and each of said springs is disposed in one of the concavities and engaged with one of said propeller blades.

3. The vehicle in accordance with claim 2 wherein each of the concavities is provided with a first stop for limiting forward movement of said blades to the first position, and a second stop for limiting rearward movement of said blades to the second position.

4. The vehicle in accordance with claim 1 wherein each of said springs is a coiled wire spring.

5. The vehicle in accordance with claim 2 wherein each of the springs comprises:

a first end disposed in one of the concavities;

a mid-portion coiled around one of the spool portions; and a second end extending from the spool portion and engaged with the propeller blade.

* * * * *